US009293816B2

(12) United States Patent
Samardzija et al.

(10) Patent No.: US 9,293,816 B2
(45) Date of Patent: Mar. 22, 2016

(54) ELECTRONIC DEVICE PLATE ANTENNA

(75) Inventors: Miroslav Samardzija, Mountain View, CA (US); Rodney A. Gomez Angulo, Sunnyvale, CA (US); Qingxiang Li, Mountain View, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 372 days.

(21) Appl. No.: 13/543,054

(22) Filed: Jul. 6, 2012

(65) Prior Publication Data

US 2014/0009355 A1 Jan. 9, 2014

(51) Int. Cl.

| | |
|---|---|
| ***H01Q 1/24*** | (2006.01) |
| ***H01Q 1/42*** | (2006.01) |
| ***H01Q 1/38*** | (2006.01) |
| ***H01Q 9/04*** | (2006.01) |
| ***H01Q 13/16*** | (2006.01) |

(52) U.S. Cl.

CPC ..... *H01Q 1/42* (2013.01); *H01Q 1/243* (2013.01); *H01Q 1/38* (2013.01); *H01Q 9/0407* (2013.01); *H01Q 13/16* (2013.01)

(58) Field of Classification Search

CPC ..... H01Q 1/243; H01Q 1/38; H01Q 13/16
USPC ..... 343/702, 872
See application file for complete search history.

(56) References Cited

U.S. PATENT DOCUMENTS

| | | | | |
|---|---|---|---|---|
| 5,394,160 | A * | 2/1995 | Iwasaki et al. | 343/702 |
| 6,191,740 | B1 | 2/2001 | Kates et al. | |
| 6,317,084 | B1 | 11/2001 | Chen et al. | |
| 6,359,595 | B1 | 3/2002 | Abraham et al. | |
| 6,456,242 | B1 * | 9/2002 | Crawford | H01Q 1/22 343/700 MS |
| 6,774,849 | B2 | 8/2004 | Umehara et al. | |
| 6,894,647 | B2 * | 5/2005 | Jenwatanavet | 343/700 MS |
| 6,914,563 | B2 | 7/2005 | Chen et al. | |
| 2008/0316120 | A1 * | 12/2008 | Hirota et al. | 343/702 |
| 2009/0085812 | A1 * | 4/2009 | Qi et al. | 343/702 |
| 2010/0103612 | A1 * | 4/2010 | Weber et al. | 361/679.56 |
| 2010/0321253 | A1 * | 12/2010 | Ayala Vazquez et al. | 343/702 |
| 2011/0050508 | A1 | 3/2011 | Guterman et al. | |

* cited by examiner

*Primary Examiner* — Dieu H Duong
(74) *Attorney, Agent, or Firm* — Treyz Law Group, P.C.; G. Victor Treyz; Michael H. Lyons

(57) ABSTRACT

An electronic device may be provided with antenna structures. The antenna structures may include a plate antenna. The electronic device may have a conductive housing such as a metal housing with an opening. A dielectric antenna window may be formed within the opening. A dielectric support structure such as a flexible printed circuit may overlap the opening. A conductive trace on the dielectric support structure may form an antenna resonating element plate for the plate antenna. The plate may have a periphery that is separated from adjacent portions of the metal housing by a gap. The antenna resonating element plate may have a rectangular shape with a bend that lies along an edge of the conductive housing. The dielectric antenna window may have a bend that also lies along the edge of the conductive housing.

17 Claims, 9 Drawing Sheets

ELECTRONIC DEVICE PLATE ANTENNA

BACKGROUND

This relates to wireless electronic devices and, more particularly, to plate antennas for wireless electronic devices.

Electronic devices such as computers, media players, cellular telephones, and other portable electronic devices often contain wireless circuitry. For example, cellular telephone transceiver circuitry and wireless local area network circuitry may allow a device to wirelessly communicate with external equipment. Antenna structures may be used in transmitting and receiving associated wireless signals.

It can be challenging to incorporate wireless circuitry such as antenna structures into an electronic device. Space is often at a premium, particularly in compact devices. Device housings are sometimes formed from metal, which can influence antenna performance. If care is not taken, antenna structures may not perform satisfactorily or may consume more space within an electronic device than desired.

It would therefore be desirable to be able to provide improved electronic device antenna structures.

SUMMARY

An electronic device may be provided with wireless circuitry. The wireless circuitry may include antenna structures for transmitting and receiving wireless signals. The wireless circuitry may also include one or more circuits such as radio-frequency transceiver circuits and impedance matching and filter circuitry. These circuits may be coupled to the antenna structures using transmission lines.

The antenna structures may include a plate antenna. The electronic device may have a conductive housing such as a metal housing with an opening. A dielectric antenna window may be formed within the opening. A dielectric support structure such as a flexible printed circuit may overlap the opening. A conductive trace on the dielectric support structure may form an antenna resonating element plate for the plate antenna. The antenna resonating element plate may be coplanar with adjacent portions of the conductive housing.

The antenna resonating element plate may have a periphery that is separated from adjacent portions of the metal housing by a gap. The antenna resonating element plate may have a rectangular shape with a bend that lies along an edge of the conductive housing. The antenna window may have a bend that also lies along the edge of the conductive housing.

Conductive traces on the dielectric support structure may be used in forming the antenna resonating element plate, an antenna feed, a transmission line that is coupled to the antenna feed, and a short circuit path that spans the gap and couples the antenna resonating element plate to ground.

Further features of the invention, its nature and various advantages will be more apparent from the accompanying drawings and the following detailed description of the preferred embodiments.

DETAILED DESCRIPTION

Figure 1:
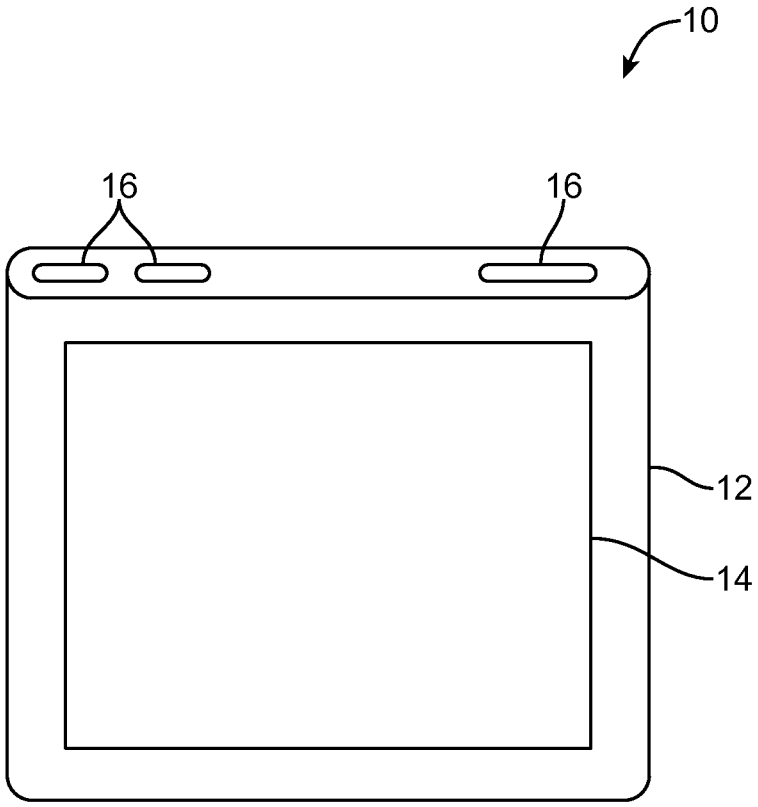
FIG. 1 is a perspective view of an illustrative electronic device containing wireless circuitry in accordance with an embodiment of the present invention.

Electronic devices such as electronic device 10 of FIG. 1 often contain wireless circuitry. The wireless circuitry may include radio-frequency transceiver circuitry and associated antenna structures for transmitting and receiving wireless signals. Electronic device 10 may be a handheld electronic device such as a portable media player or cellular telephone, may be a portable computer such as a tablet computer or laptop computer, may be a desktop computer, television, wireless access point, set-top box, or other electronic equipment. The configuration of electronic device 10 of FIG. 1 is merely illustrative.

As shown in FIG. 1, electronic device 10 may have a housing such as housing 12. Housing 12 may be formed from one or more housing structures. For example, housing 12 may be formed from one or more metal structures such as aluminum or stainless steel structures. Housing 12 may also include plastic structures, glass structures, ceramic structures, and structures formed from other materials. Housing 12 may, if desired, be formed using a unibody construction in which housing 12 or substantially all of housing 12 is formed from a single machined piece of material. Housing 12 may also be formed by joining two or more parts (e.g., first and second housing members, internal housing frame structures, etc.). To allow antennas to operate satisfactorily, one or more dielectric antenna window structures may be formed in housing 12 (e.g., plastic antenna windows or windows formed from other dielectric materials).

Device 10 may include one or more displays such as display 14. In a configuration of the type shown in FIG. 1, device 10 may have planar front and rear faces and display 14 may be mounted on the front face (as an example). Displays may also be mounted on housing sidewalls, on the rear surface of a housing, on a hinged lid portion, or in other suitable locations within electronic device 10.

Device 10 may include buttons such as buttons 16. Buttons 16 may be used for turning on and off device 10, for making volume adjustments when playing back media for a user, for making menu selections, and for otherwise facilitating user interactions with device 10. Openings may be formed in device 10 for audio jacks, digital data ports, etc. Status indicator lights and other input-output devices may also be incorporated in device 10, if desired. Wireless circuitry that includes one or more antennas may be used to wirelessly transmit and receive signals for device 10. Antenna structures in device 10 may, for example, include one or more plate antenna structures.

Figure 2:
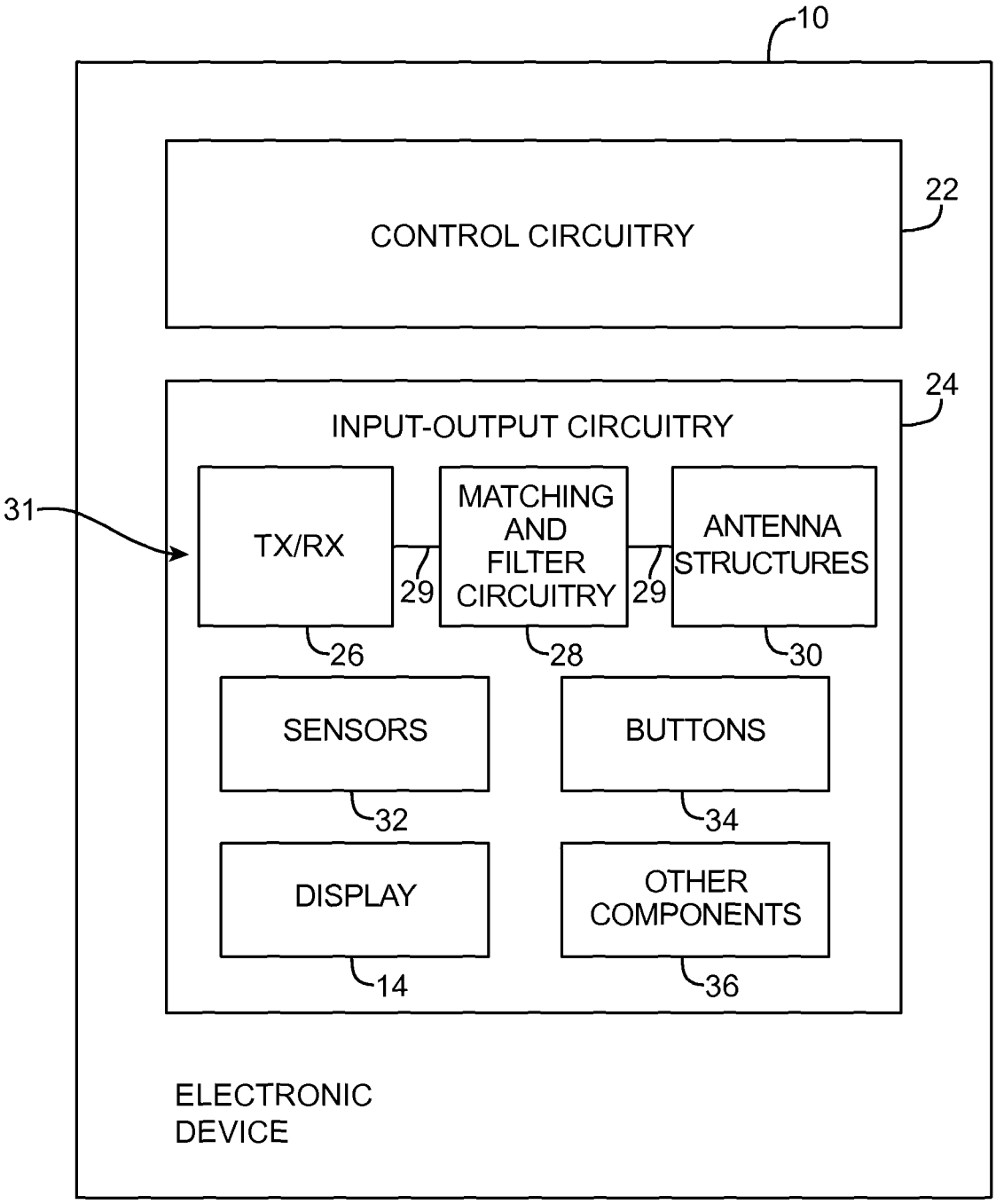
FIG. 2 is a schematic diagram of an illustrative electronic device containing wireless circuitry in accordance with an embodiment of the present invention.

FIG. 2 is a schematic diagram showing illustrative components that may be included in an electronic device such as electronic device 10 of FIG. 1. As shown in FIG. 2, electronic device 10 may include control circuitry 22 and associated input-output circuitry 24.

Control circuitry 22 may include storage and processing circuitry that is configured to execute software that controls the operation of device 10. Control circuitry 22 may include microprocessor circuitry, digital signal processor circuitry, microcontroller circuitry, application-specific integrated circuits, and other processing circuitry. Control circuitry 22 may also include storage such as volatile and non-volatile memory, hard-disk storage, removable storage, solid state drives, random-access memory, memory that is formed as part of other integrated circuits such as memory in a processing circuit, etc.

Input-output circuitry 24 may include components for receiving input from external equipment and for supplying output. For example, input-output circuitry 24 may include user interface components for providing a user of device 10 with output and for gathering input from a user. As shown in FIG. 2, input-output circuitry 24 may include wireless circuitry 31. Wireless circuitry 31 may be used for transmitting and/or receiving signals in one or more communications bands such as cellular telephone bands, wireless local area network bands (e.g., the 2.4 GHz and 5 GHz IEEE 802.11 bands), satellite navigation system bands, etc.

Wireless circuitry 31 may include transceiver circuitry such as radio-frequency transceiver 26. Radio-frequency transceiver 26 may include a radio-frequency receiver and/or a radio-frequency transmitter. Radio-frequency transceiver circuitry 26 may be used to handle wireless signals in communications bands such as the 2.4 GHz and 5 GHz WiFi® bands, cellular telephone bands, and other wireless communications frequencies of interest.

Radio-frequency transceiver circuitry 26 may be coupled to one or more antennas in antenna structures 30 using circuitry 28 and transmission line structures such as transmission lines 29. Transmission lines 29 may include coaxial cables, microstrip transmission lines, transmission lines formed from traces on flexible printed circuits (e.g., printed circuits formed from flexible sheets of polyimide or other layers of flexible polymer), transmission lines formed from traces on rigid printed circuit boards (e.g., fiberglass-filled epoxy substrates such as FR4 boards), or other transmission line structures. Circuitry 28 may include impedance matching circuitry, filter circuitry, switches, and other circuits. Circuitry 28 may be implemented using one or more components such as integrated circuits, discrete components (e.g., capacitors, inductors, and resistors), surface mount technology (SMT) components, or other electrical components. Antenna structures 30 may include inverted-F antennas, patch antennas, loop antennas, monopoles, dipoles, or other suitable antennas. Configurations in which at least one antenna in device 10 is formed from a patch antenna structure are sometimes described herein as an example.

Sensors 32 may include an ambient light sensor, a proximity sensor, touch sensors such as a touch sensor array for a display and/or touch buttons, pressure sensors, temperature sensors, accelerometers, gyroscopes, and other sensors.

Buttons 34 may include sliding switches, push buttons, menu buttons, buttons based on dome switches, keys on a keypad or keyboard, or other switch-based structures.

Display 14 may be a liquid crystal display, an organic light-emitting diode display, an electrophoretic display, an electrowetting display, a plasma display, or a display based on other display technologies. Display 14 may include a touch sensor array or may be insensitive to touch.

Device 10 may also contain other components 36 (e.g., communications circuitry for wired communications, status indicator lights, vibrators, speakers, microphones, cameras, etc.).

Antenna structures 30 may be formed using conductive structures such as patterned metal foil or metal traces. The conductive structures of antenna structures 30 may be supported by ceramic carriers, plastic carriers, and printed circuits (as examples). Conductive materials for antenna structures 30 such as metal may, for example, be supported on dielectric substrates such as injection-molded plastic carriers, glass or ceramic members, or other insulators.

If desired, patterned metal traces for an antenna may be formed on printed circuit substrates. An antenna may be formed, for example, using metal traces on a printed circuit such as a rigid printed circuit board or on a flexible printed circuit. Antenna structures that are formed on printed circuit substrates may be mounted on the inner surface of a dielectric antenna window in an opening in a metal electronic device housing. For example, a layer of adhesive or other attachment mechanism may be used in mounting a flexible printed circuit to the inner surface of a dielectric antenna window. Antenna structures may also be formed from traces that are deposited and patterned on the inner surface of a dielectric antenna window structure, may be formed on a dielectric carrier that is biased against the inner surface of an antenna window using foam or other biasing structures, or may be mounted in device 10 using other mounting schemes.

Figure 3:
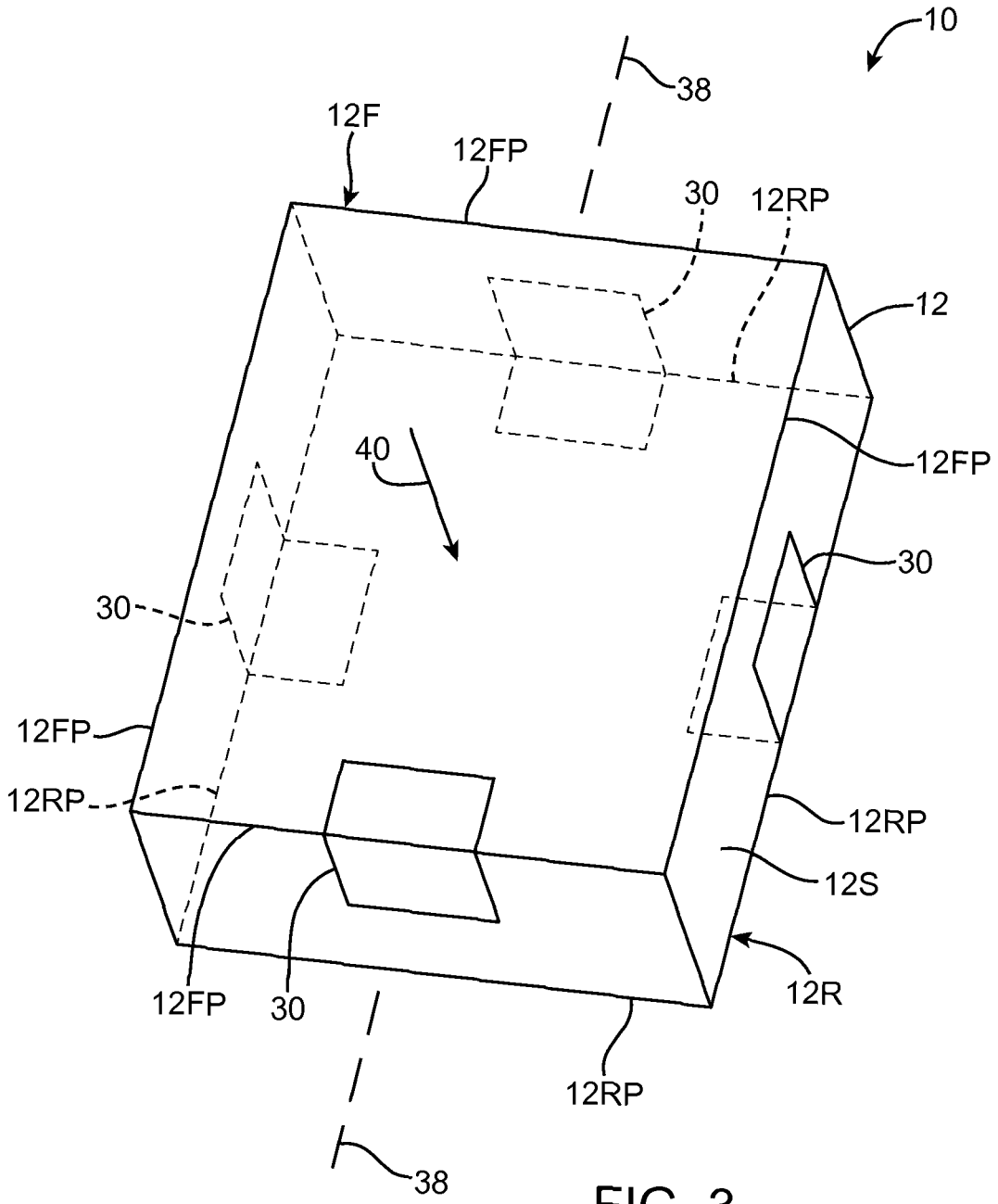
FIG. 3 is a perspective view of an electronic device housing showing illustrative locations for plate antenna structures in accordance with an embodiment of the present invention.

In configurations for device 10 in which housing 12 is formed from metal, one or more openings may be formed in housing 12 to accommodate antenna structures 30. FIG. 3 is a perspective view of an illustrative housing configuration for electronic device 10. As shown in FIG. 3, housing 12 may have a planar front surface such as rectangular front surface 12F and may have a planar rear surface such as rear surface 12R. Surfaces 12F and 12R may line in planes that are parallel to each other. If desired, surfaces 12F and 12R may be curved. Sidewall structures such as sidewalls 12S may run vertically between surfaces 12F and 12R as shown in the example of FIG. 3 or may have other shapes. As an example, sidewalls 12S may be formed from curved portions of the housing walls that form front surface 12F and rear surface 12R and device 10 may have an oval cross-sectional shape (e.g., when viewed along longitudinal axis). In the example of FIG. 3, device housing 12 has a rectangular footprint (i.e., device housing 12 has a rectangular outline when the front face of device housing 12 is viewed in direction 40). This is merely illustrative. The footprint of device housing 12 (and the cross-sectional shapes of housing 12) may have circular outlines, oval outlines, rectangular outlines, outlines with straight edges, outlines with curved edges, and outlines with combinations of curved and straight edges.

In configurations for device 10 such as the illustrative configuration of FIG. 3, housing 12 may have edges such as front face peripheral edges 12FP and rear face peripheral edges 12RP. There may be, for example, four front peripheral edges 12FP that form a rectangular periphery for the front surface of device 10 and four rear peripheral edges 12RF that form a rectangular periphery for the rear surface of device 10. Antenna structures 30 may be located in rectangular openings in the metal housing or in openings of other suitable shapes. As shown in FIG. 3, for example, antenna structures 30 may, if desired, be formed in one or more rectangular openings with bends along device housing edges such as edges 12FP and 12RP. Device housing 12 may be formed from metal and the openings for antenna structures 30 may be contain dielectric antenna windows such as plastic antenna windows that conform to the bent rectangular shape of the openings of FIG. 3. Four illustrative antenna window locations are shown in FIG. 3 each of which has a single right-angle bend along a housing edge. This is merely illustrative. There may be any suitable number of antennas in device 10 (e.g., one antenna, two antennas, three antennas, or four or more antennas). Each antenna may be a plate antenna with a plate antenna resonating element that has a rectangular outline (when in a flattened state) or other types of antenna resonating element shapes may be used. Antenna resonating element structures (e.g., rectangular antenna plates) may have one bend, two bends, or more than two bends. Bends may be formed at right angles, may have curved bent shapes (e.g., gradually changing surfaces), or may be formed using other angles or other shapes. Bent antenna plate structures may be formed along side edges of housing 12 (e.g., housing edges that run parallel to longitudinal axis 38 of an elongated version of housing 12) or may be formed along end edges of housing 12 (e.g., housing edges that run perpendicular to longitudinal axis 38). Plate antenna structures may also be formed with no bends (e.g., when formed in an antenna window in rear housing surface 12R).

Figure 4:
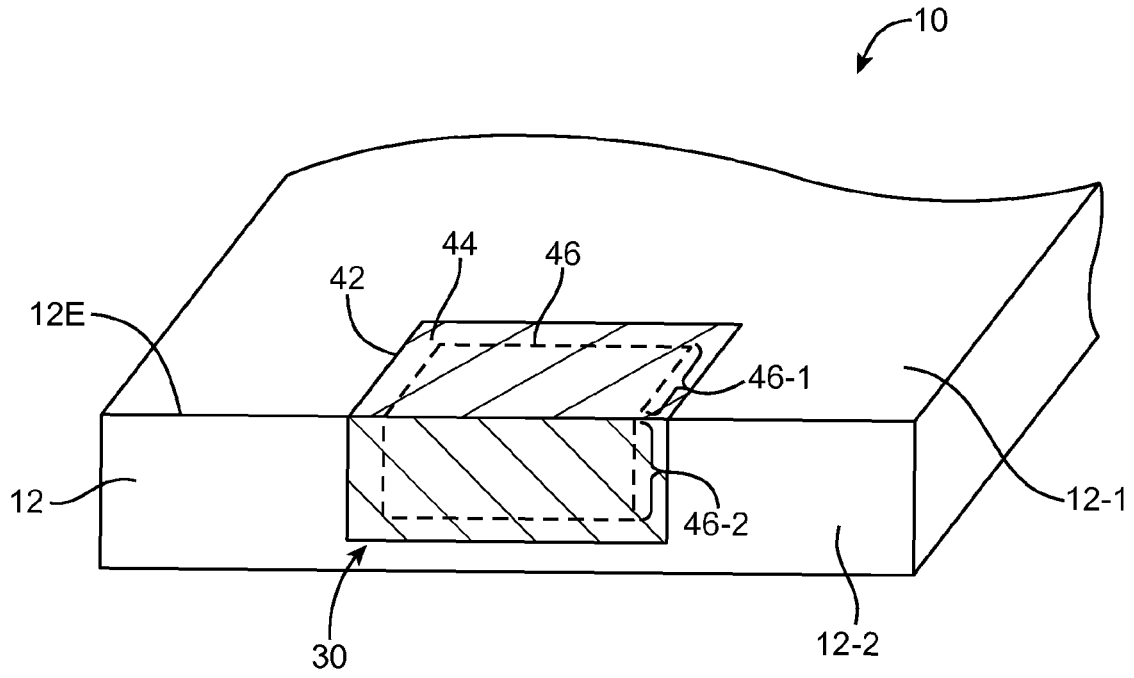
FIG. 4 is a perspective view of a portion of a housing in an electronic device with a dielectric antenna window and a plate antenna that has been mounted in an interior portion of the electronic device under the dielectric antenna window in accordance with an embodiment of the present invention.

FIG. 4 is a perspective view of an end portion of device housing 12 showing how metal device housing 12 may have a rectangular opening such as rectangular opening 42. Opening 42 may have a bend (e.g., a right angled bend) along end edge 12E. Opening 42 may be filled with a dielectric antenna window such as plastic antenna window 44. Rectangular plate antenna resonating element 46 may be mounted under dielectric antenna window 44 (i.e., so that the outline of resonating element 46 lies within the outline of window 44). Antenna structures 30 of FIG. 4 may form a plate antenna. Metal housing 12 may have portions surrounding window 44 that form an antenna ground. A conductive plate structure such as rectangular antenna resonating element 46 may form a plate antenna resonating element that forms a plate antenna for device 10 in conjunction with the antenna ground. The conductive plate structure may be co-planar with the planar outer surface of housing 12 (i.e., antenna plate 46 may have a planar portion such as portion 46-1 that lies in the same plane as adjacent front housing surface portion 12-1 and may have a planar portion such as portion 46-2 that lies in the same plane as adjacent end wall housing surface portion 12-2. Plate 46 may be coplanar with housing 12 in configurations in which plate 46 as no bends, in configurations in which plate 46 has one bend (e.g., as in FIG. 4), and in configurations in which plate 46 has two or more bends. Because plate 46 is coplanar with device housing 12, plate 46 can reside near the surface of housing 12 under antenna window 44.

Figure 5:
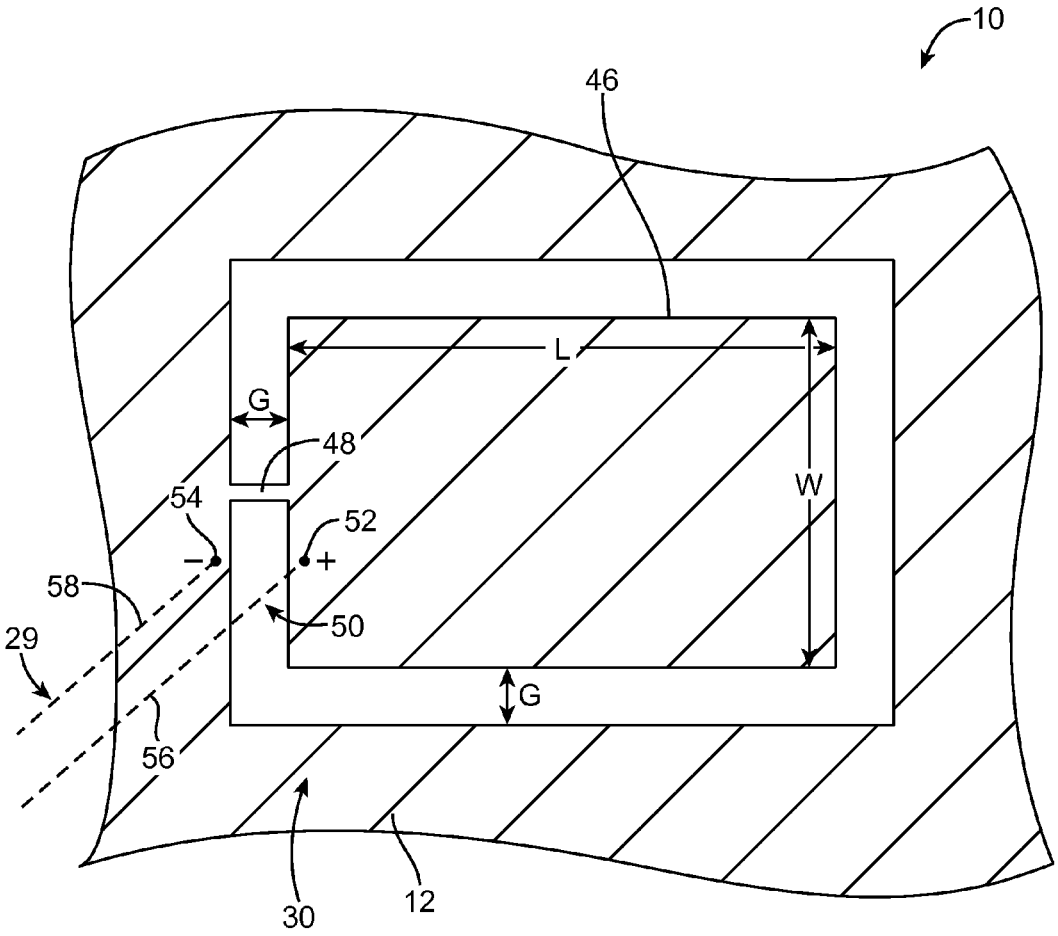
FIG. 5 is a diagram showing how plate antenna may be separated from a rectangular opening in a metal electronic device housing by a peripheral gap in accordance with an embodiment of the present invention.

Plate antennas such as antenna 30 may be used in one of the housing walls of device housing 12, may be provided with one or more bends (e.g., so that the antenna covers multiple housing walls), and/or may be provided with a gradually changing curve or other shape that allows antenna plate 46 to conform to the exterior shape of housing 12. Regardless of the cross-sectional shape of plate antenna 30 (flat, flat with one or more bends, curved, etc.), plate antenna resonating element 46 may be separated from conductive housing 12 (i.e., antenna ground) by a gap G, as shown in the diagram of FIG. 5. In FIG. 5, plate antenna resonating element 46 and the surrounding antenna ground formed by nearby portions of housing 12 have been flattened to show how a dielectric-filled gap G may separate plate antenna resonating element 46 from surrounding portions of electronic device housing 12.

A short circuit path such as short circuit path 48 may bridge gap G. Antenna 30 may have an antenna feed with a positive antenna feed terminal such as positive antenna feed terminal 52 and a ground antenna feed terminal such as ground antenna feed terminal 54. Transmission line 29 in wireless circuitry 31 may have a positive signal conductor such as conductive line 56 that is coupled to positive antenna feed terminal 52 and may have a ground signal conductor such as conductive line 58 that is coupled to ground antenna feed terminal 54.

Plate antenna 46 may be characterized by lateral dimensions such length L and width W. The size of dimensions L and W, and the magnitude of gap G may be selected to optimize antenna performance for antenna 30. For example, length L may be configured to be about a quarter of a wavelength at operating frequencies of interest to enhance the size of the antenna resonant peak associated with those operating frequencies and thereby enhance antenna efficiency. At an illustrative operating frequency of 2.4 GHz, for example, the size of length L may be about 25-35 mm. The magnitude of width W may be selected to match the impedance of antenna 30 to a desired impedance (e.g., the impedance of transmission line 29). Width W may be, for example less than a quarter of a wavelength. The size of gap G may be, for example, between a tenth of a wavelength and a twentieth of a wavelength at the operating frequency of interest.

Figure 6:
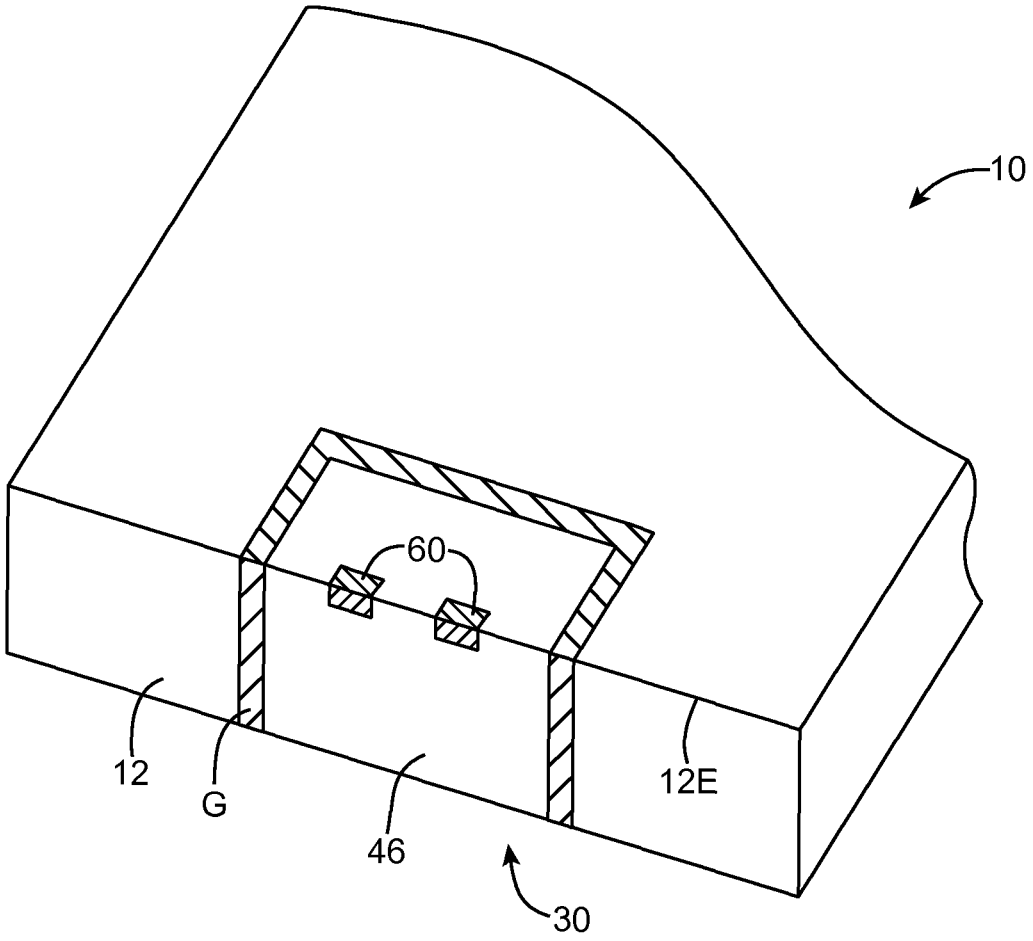
FIG. 6 is a perspective view of a plate antenna with a bend showing how openings may be formed in the plate antenna along the bend to promote flexibility in accordance with an embodiment of the present invention.
Figure 7:
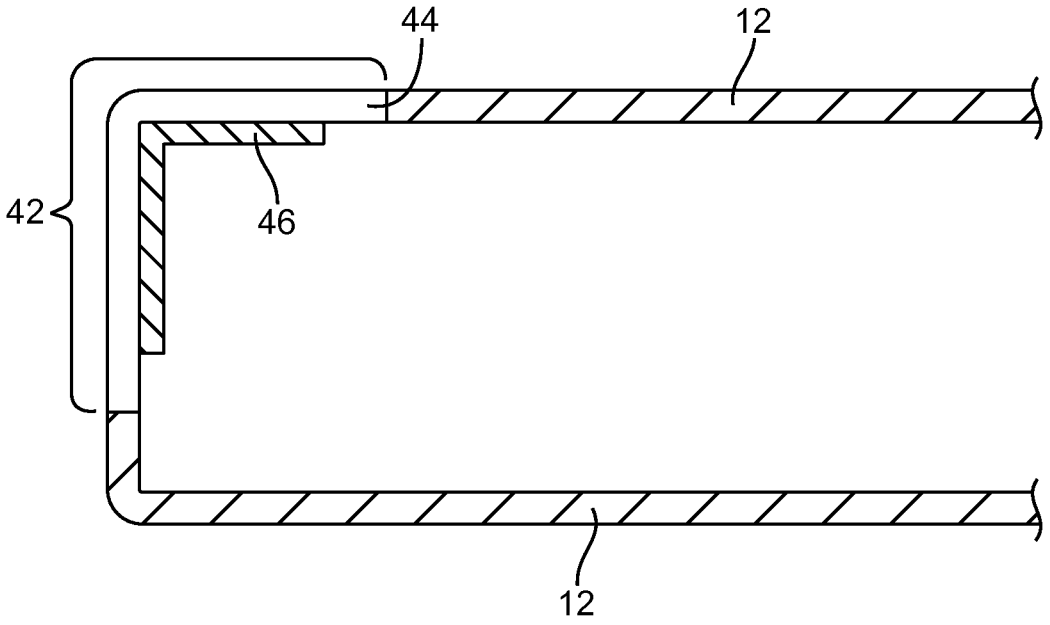
FIG. 7 is a cross-sectional side view of a plate antenna mounted under an overlapping dielectric window in a metal electronic device housing in accordance with an embodiment of the present invention.

FIG. 6 is a perspective view of an end portion of device 10 showing how plate antenna 30 may be formed from an antenna resonating element that bends around at least one edge of housing 12 and that has one or more openings. As shown in FIG. 6, antenna resonating element 46 of plate antenna 30 may be formed from a rectangular conductive member (e.g., a bent metal rectangle) having a bend that runs along edge 12E of electronic device housing 12. Antenna resonating element 46 may be separated from adjacent portions of metal housing 12 (which form antenna ground) by gap G. Gap G may be filled with air, plastic, or other dielectric materials. As shown in FIG. 6, antenna resonating element 46 may have one or more openings such as openings 60 that run along edge 12E. The size of openings 60 may be selected to be smaller than a quarter wavelength at the operating frequency of interest for antenna 30 to ensure that the presence of openings 60 do not affect antenna performance. Because some of the metal in antenna resonating element 46 along the bend on edge 12E is removed when forming openings 60, the flexibility of antenna resonating element 46 along edge 12E may be enhanced by the presence of openings 60. Enhanced resonating element flexibility may help resonating element 46 conform to the shape of housing 12. There may be one opening 60, two openings 60, three openings 60, or four or more openings 60. The illustrative configuration of FIG. 6 in which two openings 60 have been formed in antenna resonating element 46 overlapping the bend in resonating element 46 along housing edge 12E is merely illustrative.

Figure 8:
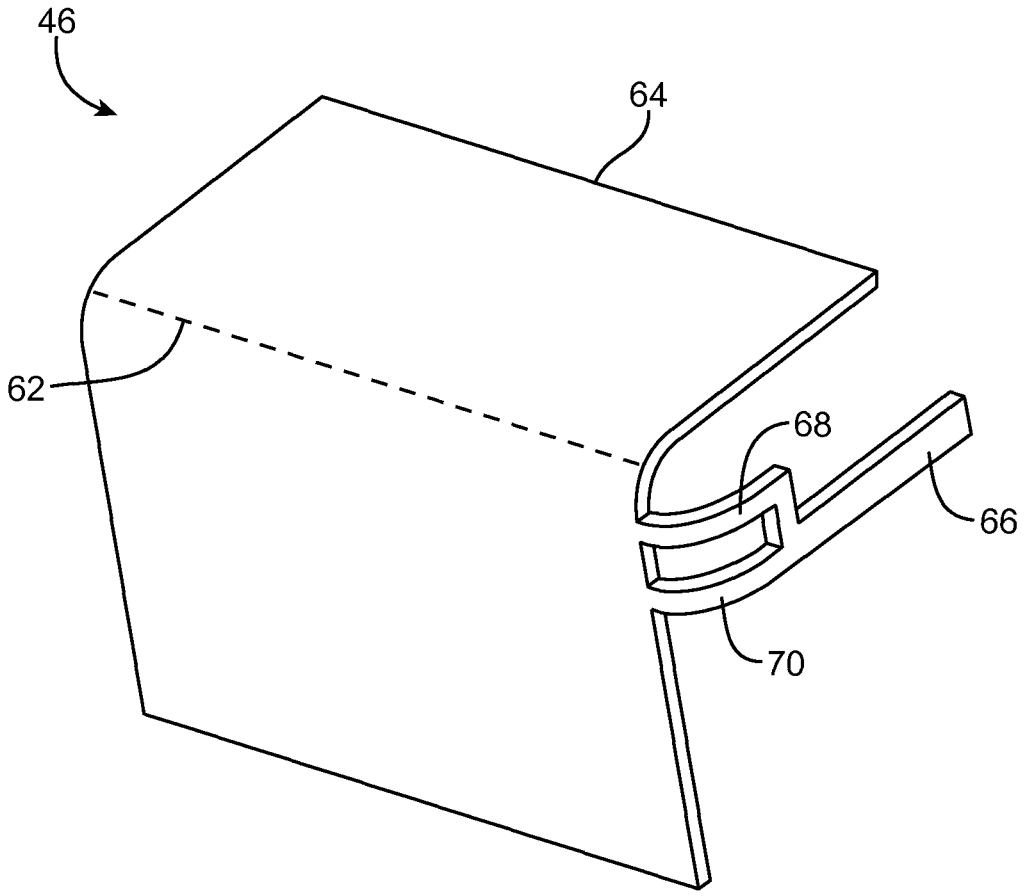
FIG. 8 is a perspective view of a flexible printed circuit substrate of the type that may be used in forming a plate antenna with one or more bends in accordance with an embodiment of the present invention.

A perspective view of an illustrative plate antenna resonating element is shown in FIG. 8. As shown in FIG. 8, plate antenna resonating element 46 may have a dielectric substrate such as substrate 64 on which conductive traces may be formed (e.g., metal traces such as copper traces in the shape of a rectangular plate or other suitable plate shape). Substrate 64 may be formed from a flexible printed circuit material such as polyimide or a sheet of other polymer material. Substrate 64 may be bent along one or more bend lines such as bend line (axis) 62. Axis 62 may be aligned with an edge of housing 12 such as edge 12E of FIG. 4. Substrate 64 may have portions such as portions 68 and 70 that span gap G. Portion 70 may, for example, contain traces for forming a feed path for an antenna feed such as antenna feed 50 of FIG. 5. Portion 68 may contain traces for forming a short circuit path between the plate conductor of resonating element 46 and ground such as short circuit path 48 of FIG. 5. Portion 66 may contain transmission line conductive traces such as traces for forming conductive paths 56 and 58 of transmission line 29 of FIG. 5. The locations of antenna feed 50 and short circuit path 48 along the periphery of the conductive plate in resonating element 46 may be selected to tune antenna performance (e.g., the size and frequency location of antenna resonances exhibited by antenna 30).

Figure 9:
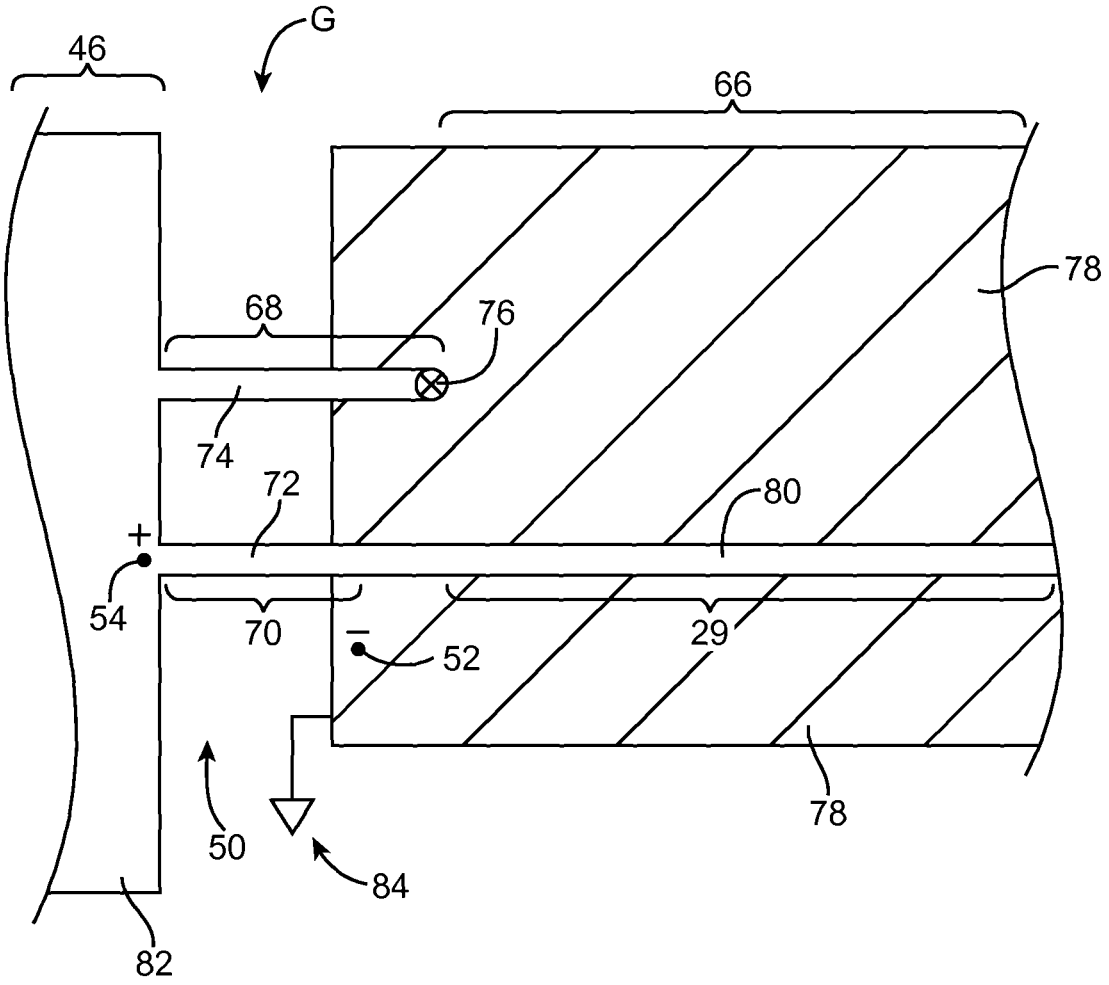
FIG. 9 is a diagram showing how conductive traces on a portion of the flexible printed circuit substrate of FIG. 8 may be used in forming short circuit and antenna feed connections to a plate antenna resonating element in accordance with an embodiment of the present invention.

Substrate 64 may be a flexible printed circuit with multiple layers of conductive traces (e.g., two or more layers of traces). FIG. 9 is a diagram showing how the conductive traces in this type of substrate may be used to feed and ground plate antenna resonating element 46 to 20 antenna ground. As shown in FIG. 9, antenna plate resonating element 46 may have a rectangular metal trace (plate element) such as conductive antenna resonating element trace 82. Trace 82 may be formed from a first layer of metal on flexible printed circuit substrate 64. Path 68 25 may be formed by coupling an extended portion of this first metal layer (i.e., extended first layer trace portion 74, which spans dielectric gap G) to a ground formed by a second layer of metal on flexible printed circuit substrate 64 such as second metal layer 78. As shown by ground 84, second metal layer 78 may be shorted to ground (e.g., portions of device housing 12 in the vicinity of antenna 30). A via such as via 76 may be used to electrically connect trace portion 74 of the first layer of metal to ground trace 78 in the second layer of metal. Antenna feed 50 may be formed 5 from extending portion 72 of trace 82 in the first layer of metal that spans gap G. Extending portion 72 may be supported by substrate portion 68 (FIG. 8). One end of extending portion 72 may be coupled to positive antenna feed terminal 54 of feed 50 and an opposing end of extending 10 portion 72 may be coupled to first layer trace 80. Extending portion 72 may be supported by substrate portion 70 (FIG. 8). Ground antenna terminal 54 may be coupled to trace 78 across gap G from positive antenna terminal 52. Trace 80 in the first layer of metal and trace 78 in the 15 second layer of metal may be separated by a layer of insulator (flexible printed circuit material) and may form transmission line 29 (FIG. 5). Trace portion 74 may form short circuit path 48 of FIG. 5.

The foregoing is merely illustrative of the principles of this invention and various modifications can be made by those skilled in the art without departing from the scope and spirit of the invention. The foregoing embodiments may be implemented individually or in any combination.

What is claimed is:

1. Apparatus, comprising:

a plate antenna having an antenna ground and a plate antenna resonating element with a periphery, wherein a dielectric gap separates the periphery of the plate antenna resonating element from the antenna ground;

a conductive electronic device housing having an opening in which the plate antenna resonating element is located and having portions that form the antenna ground;

a dielectric antenna window in the opening;

a dielectric support structure overlapping at least part of the opening, wherein the dielectric support structure is mounted against an inner surface of the dielectric antenna window with a layer of adhesive and the dielectric support structure has a first portion formed in a first plane, a second portion formed in a second plane that is substantially orthogonal to the first plane, and a third portion formed in a third plane that is substantially orthogonal to the first and second planes;

a conductive plate structure on the dielectric support structure, wherein the conductive plate structure is configured to form the plate antenna resonating element; and an antenna feed trace for the plate antenna resonating element that is formed on the third portion of the dielectric support structure.

2. The apparatus defined in claim 1 wherein the dielectric support structure comprises a flexible printed circuit.

3. The apparatus defined in claim 2 wherein the flexible printed circuit includes at least a first layer of metal and a second layer of metal.

4. The apparatus defined in claim 3 wherein a portion of the first layer of metal is configured to form the conductive plate structure.

5. The apparatus defined in claim 4 wherein the second layer of metal is shorted to the antenna ground.

6. The apparatus defined in claim 5 wherein the first layer of metal has an extending portion that extends from the conductive plate structure over the gap.

7. The apparatus defined in claim 5 wherein the first layer of metal has first and second extending portions that extend from the conductive plate structure over the gap, the first extending portion has a first end attached to the conductive plate structure and a second end attached to the second layer of metal, and the second extending portion has a first end attached to the conductive plate structure and a second end that is coupled to a conductive line formed from the first layer of metal.

8. The apparatus defined in claim 7 further comprising a transmission line coupled to the plate antenna, wherein the conductive line forms a positive signal conductor in the transmission line and a portion of the second layer of metal is configured to form a ground signal conductor in the transmission line.

9. The apparatus defined in claim 1, wherein the portions of the conductive electronic device housing that form the antenna ground have a surface that forms an exterior portion of the apparatus.

10. The apparatus defined in claim 9, wherein the dielectric support structure comprises polyimide, and the dielectric support structure comprises a portion that extends entirely across the dielectric gap.

11. The apparatus defined in claim 1, wherein the plate antenna resonating element is formed on the first and second portions of the dielectric support structure.

12. An electronic device, comprising:

a metal housing having an opening and having portions that form an antenna ground;

a dielectric antenna window in the opening; and a conductive antenna resonating element plate in the opening, wherein the conductive antenna resonating element plate and the antenna ground are configured to form a plate antenna, the metal housing has an edge, the opening overlaps the edge, the conductive antenna resonating element plate has a right-angled bend along the edge, the conductive antenna resonating element plate includes at least one additional opening that is formed within the conductive antenna resonating element, that overlaps the edge, and that enhances flexibility of the conductive antenna resonating element along the edge, and the at least one additional opening does not affect radio-frequency performance of the antenna.

13. The electronic device defined in claim 12 wherein the conductive antenna resonating element plate and the portions of the metal housing that form the antenna ground are coplanar.

14. The electronic device defined in claim 13 wherein the conductive antenna resonating element plate comprises a rectangular metal trace.

15. The electronic device defined in claim 14 further comprising a flexible dielectric on which the rectangular metal trace is formed.

16. The electronic device defined in claim 12, wherein the at least one additional opening within the conductive antenna resonating element that overlaps the edge is completely surrounded by the conductive antenna resonating element plate.

17. The electronic device defined in claim 16, wherein the at least one additional opening within the conductive antenna resonating element that overlaps the edge has a size that is smaller than a quarter wavelength of the operating frequency of the conductive antenna resonating element plate.

* * * * *